United States Patent [19]

Piana et al.

[11] Patent Number: 4,586,671

[45] Date of Patent: May 6, 1986

[54] MULTIPLE STRIP DISPENSER

[75] Inventors: Ivana Piana; Silvano Piana, both of Genoa, Italy

[73] Assignee: Grafoplast s.a.s., Italy

[21] Appl. No.: 551,044

[22] Filed: Nov. 14, 1983

[30] Foreign Application Priority Data

Apr. 1, 1983 [IT] Italy ..... 12481 A/83

[51] Int. Cl.[4] ..... B65H 16/06

[52] U.S. Cl. ..... 242/55.53; 206/389; 206/509; 225/51; 242/74

[58] Field of Search ..... 242/55.53, 195, 197, 242/74; 206/389, 391, 53, 509; 220/339, 23.4, 23.6; 225/51; 352/123

[56] References Cited

U.S. PATENT DOCUMENTS

| | | | |
|---|---|---|---|
| 757,844 | 4/1904 | Scott | 225/51 X |
| 1,045,311 | 11/1912 | Moberg | 242/55.3 |
| 1,082,964 | 12/1913 | MacDonald | 242/55.53 |
| 2,468,767 | 5/1949 | Lloyd | 242/74 |
| 2,610,000 | 9/1952 | Vierson . | |
| 2,825,450 | 3/1958 | Lambert | 242/55.53 |
| 3,127,017 | 3/1964 | Dower | 206/391 X |
| 3,129,813 | 4/1964 | Norvelle | 242/55.53 |
| 3,162,320 | 12/1964 | Hitch | 220/23.4 |
| 3,446,343 | 5/1969 | Zimmer et al. | 242/55.53 |
| 3,856,178 | 12/1974 | Norgaard | 206/509 X |
| 4,262,835 | 4/1981 | Wrobel . | |
| 4,385,958 | 5/1983 | Long | 242/197 X |

FOREIGN PATENT DOCUMENTS

| | | |
|---|---|---|
| 5970 | 5/1979 | European Pat. Off. . |
| 7420818 | 6/1974 | Fed. Rep. of Germany . |
| 708377 | 5/1954 | United Kingdom . |
| 1062330 | 3/1967 | United Kingdom . |
| 1255160 | 12/1971 | United Kingdom . |
| 2020246 | 11/1979 | United Kingdom . |

*Primary Examiner*—Billy S. Taylor

*Attorney, Agent, or Firm*—Jacobs & Jacobs

[57] ABSTRACT

This invention relates to dispensers comprising one or various interconnected holders, the or each holder being formed by two box-shaped components with an outlet opening in which a rotary drum is housed. A flexible strip or elements of any suitable nature is wound around the drum, to be used together with elements of other strips for marking of wires, cables, electrical equipment and systems. These strips of elements protrude from the hole in each holder and can be cut to any length and removed progressively by turning the drum. A multiple holder dispenser provides for tidy and methodical arrangement of the marking elements and for easy and safe utilization.

5 Claims, 17 Drawing Figures

MULTIPLE STRIP DISPENSER

This invention relates to holders and dispensers for continuous or strip mounted elements to be used for marking of cables, wires, electrical equipment and systems. Various systems are nowdays known for such marking, as for instance rings of different sizes, according to the cable diameter, bearing stamped alphanumerical items on their outer surface.

These marked rings are slipped over the cable before its final connection to identify the cable in question. Obviously, one or several such rings can be used for wire or cable identification, thus forming a multiple code or marking. Since it would be troublesome to put various helter-skelter stored rings together, proper strip, tubular assemblies of variously sized rings or sleeves, all bearing the same identification code have been created in which the rings are interconnected by a narrow link.

These tubular ring marker assemblies are, however, difficult to handle since they get easily tangled and have thus to be kept carefully separated, so that the operator can pick them up easily, detach the rings he needs and put them back in good order.

Another wire marking system is also known in which the marking elements are introduced in the recesses of a support. In this case, all rings have the same size, while the supports vary according to their utilization and the cable size. Pressure sensitive tags, dovetail supports, open or closed sleeves etc., can be used for this purpose. It is obvious that in this case too, the marking elements differentiated according to configuration and code, are drawn in long strips, but keeping all these numerous elements in neat order and at hand will still be difficult so that the wire marking operation takes a rather long time.

This invention has the aim to create a holder and a multiple dispenser combining a plurality of said holders obviating the above-mentioned drawbacks and keeping the various marking elements neatly arranged to facilitate their selection and handling.

According to one aspect of the invention, this dispenser is one of various snap holders that can be assembled, the holder or each holder (if there are several) having an outlet opening (hole) and being made up of two boxlike components closing around a rotary drum on which the above-mentioned strip of marking elements is wound.

According to another aspect of the invention, there is provided an assembly of dispensing holders, each comprising a rotatable drum for carrying a strip of elements to be dispensed through an opening in the holder, and each being openable to permit replacement of the strip, wherein the holders are detachably connected by the push fitting of brims on one holder in holes in the adjacent holder.

An embodiment of the invention in question is illustrated in one of its implementation modes and various element strips useable therewith is illustrated in the enclosed drawings, in which.

With reference to the above illustrations, each holder consists of two parts; a lower component of adequate depth (1) and an upper part (2) acting as a cover. These two parts 1 and 2 are joined by narrow sections 3 which may either be separate hinges or, as illustrated, may be integral hinges of molten plastic strips with sufficient elasticity to permit opening and closing of the holder.

Figure 17:
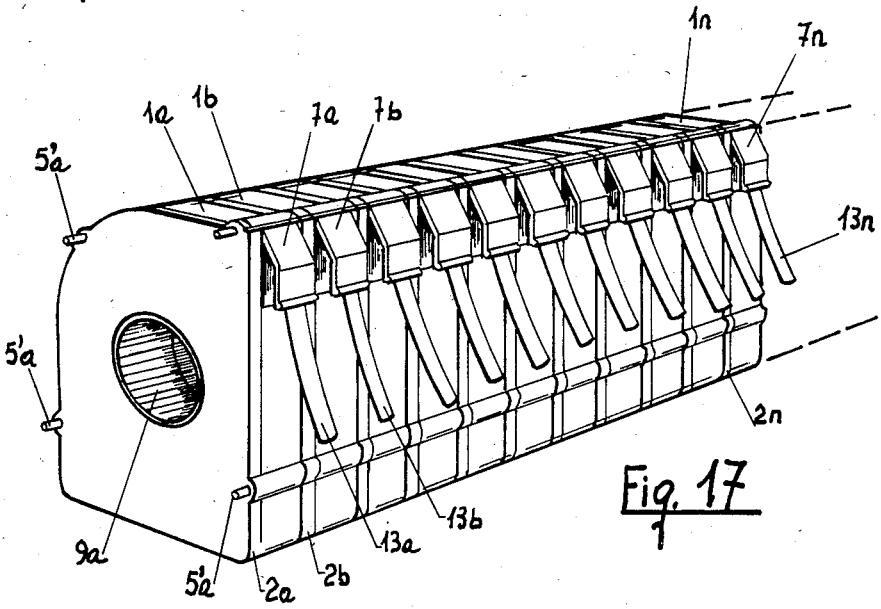
FIG. 17 shows a multiple dispenser ready for use.

Locking devices are provided along the peripheral rim of the holders, for keeping the holder closed and comprise drilled swellings 4 on the lower part and matching pin teeth 5 machined in the upper part so that these pins 5 will enter the drilled holes 4 when the holder is closed. Other tooth pins 5' are mounted on the external wall of the cover 2 and such other pins 5' are provided to coincide with the internal pins 5, and will therefore engage with the holes 4 drilled in the lower part 1 of the adjacent holder, so as to obtain a connected assembly of the various holders 1*a*, 1*b* . . . forming the multiple dispenser illustrated in FIG. 17.

These holders are substantially square shaped with more or less rounded edges. An opening 6 appears in one corner of the lower part 1, protected externally by a slightly outwards bent portion or tongue of the wall 7.

Both parts 1 and 2 of the holder have a large-sized central boring 8, in which the rotating drum is lodged.

This drum consists of a drilled core 9 and two circular flanges 10; the core 9 is extending beyond these flanges 10 so that it enters the borings 8 of the holder, meshing permanently, allowing the drum to rotate.

Flange 10 in the drum, for instance the upper one, has a radial slot 11, flaring outwards while the core 9 has a similar slot 12 coinciding with slot 11.

Figures 1, 2, 3, 4, 5, 6, 7, 8:
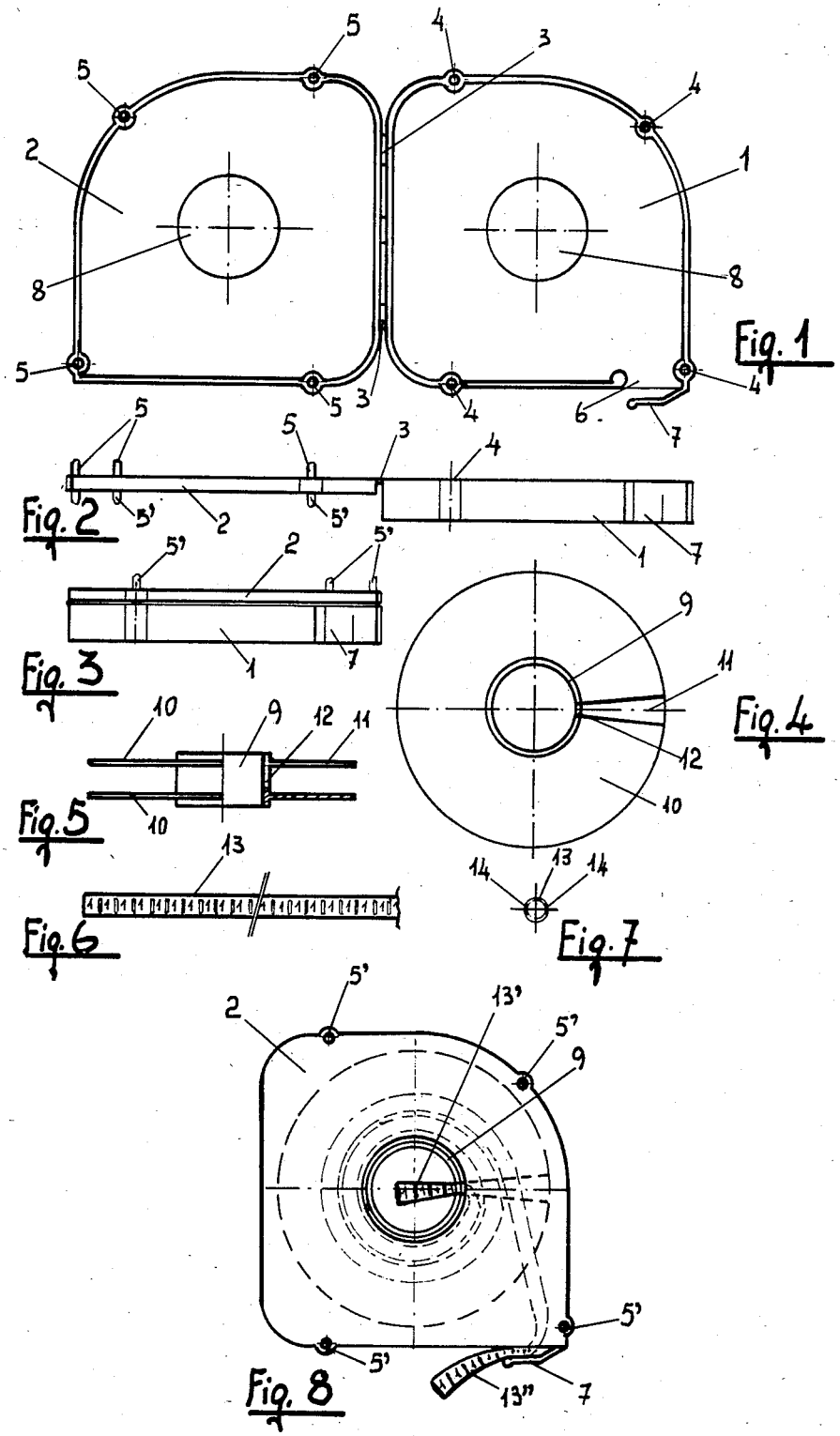
FIG. 1 shows a top view of an open, multiple dispenser holder.
FIG. 2 shows a side view of the holder illustrated in FIG. 1.
FIG. 3 shows a side view of the holder illustrated in FIG. 1 when closed.
FIG. 4 shows a top view of the drum on which a tubular shaped marker element strip is wound.
FIG. 5 shows a side and partial sectional view of the drum illustrated in FIG. 4.
FIGS. 6 and 7 are views respectively showing a side view and cross section of a tubular strip of marker rings or sleeves.
FIG. 8 shows a top view of the complete holder, ready for use.

The strip of marker ring elements illustrated in FIGS. 6 and 7 is a tubular assembly 13, usually in soft and flexible plastic consisting of marker elements interconnected by one or two narrow links 14. Each marker element is separated from its neighbor by cutting the connecting links 14. As explained above, each marking element bears a code, which in the exemplification is the code '1'.

The dispenser is prepared ready for use by threading the initial section 13' of the ring assembly 13 into the slot 11 of the disc and into the slot 12 in the drum core, leaving a few marking elements free inside the drum.

The size of the slot 12 in the drum core is generally smaller than the diameter of the marking element strip 13, the strip will be flattened in being pushed into slot 12 and will settle stably without slipping out, thus also being assisted by the notches between rings which are locked against the edges of the slot 12 in the drum.

Having thus locked one end of the marker assembly 13, the latter can be wound on the drum.

The coiled drum is placed in the lower portion 1 of the holder and the free end section 13" of the tubular marker assembly is brought outside through the opening 6 and between the wall of the lower part and the tongue 7.

The distance between the external wall of the holder and the tongue 7 is chosen to be less than the diameter of the marker element strip 13, so that the tubular strip is squeezed between the tongue 7 and wall 6 and is stably positioned to permit smooth extraction of the tubular marking assembly. Thus rigged, the container is ready for use and the operator can remove and cut the various marking elements progressively, until the holder is almost completely empty.

After emptying, the dispenser can be easily reloaded with a new marker strip.

Since various marker elements are necessary to make up an alphanumerical code, a multiple dispenser can be devised for the holders containing different marking elements all of the same size, or with various sized assemblies, all bearing the same code or else, a mixed multiple container.

Figure 9:
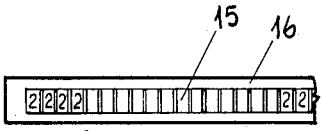
FIGS. 9 and 10 are views respectively showing a top view and cross section of a continuous marker element strip to be wound on the drum of FIG. 4.
Figure 10:
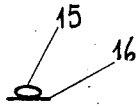

The observations for the marking elements are also valid for other equipment used for wire and cable marking and for the identification of electric terminals and equipment, for instance FIGS. 9 and 10 show marking elements 15 for instance bearing the number '2' glued onto a supporting strip 16 wound on the drum; in this case, the marking elements are removed from the strip with the well known tabs for placing the identification elements in the transparent supporting sleeves.

Figure 11:
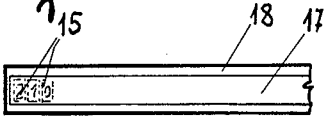
FIGS. 11 and 12 are views respectively showing a top view and cross section of a continuous pressure sensitive support for a strip or marker element to be wound on the drum.
Figure 12:
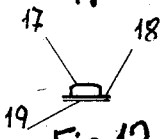
Figure 13:
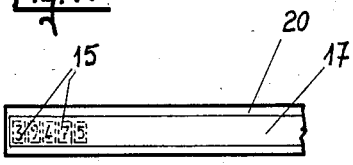
FIGS. 13 and 14 are views respectively showing a top view and cross section of a continuous supporting strip for marker elements for terminals to be wound on the drum.
Figure 14:
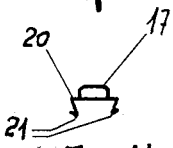
Figure 15:
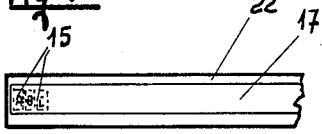
FIGS. 15 and 16 are views respectively showing a top view and cross section of a supporting strip for cable marker elements to be wound on the drum.
Figure 16:
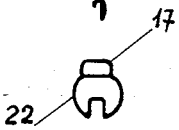

These supports too can be devised as an assembly to be wound on the drum, for instance, FIGS. 11 and 12 show a support consisting of a recess 17 fastened onto a flat pressure sensitive tag 18, protected by a removable film 19 or as shown in the FIGS. 13 and 14, of a recess 17 fastened onto a pressure holder 20 with pins 21 for snap fastening of the support by means of a dovetail for cable and wire marking, the recess is fastened onto an open or closed sleeve 22 applied onto the cables shown in FIGS. 15 and 16.

With the equipment shown in the FIGS. 9 to 16, it will be possible to prepare multiple dispensers with various marking elements and various supports as described above.

It is thus obvious that a multiple dispenser as illustrated will permit the keeping of the various wire and cable marking elements separated and in neat order for the identification of cables, wires, terminals, electric equipment and lighting fixtures, while facilitating the formation of the codes.

Obviously, the multiple dispenser subject matter of this invention which is particularly suitable for identification purposes as stated above, can be conveniently used also for any other continuous or strip shaped product in different sizes and shapes and in this case adjustments and variations may be possible, still within the scope of this invention as defined in the appended claims.

What is claimed:

1. A dispenser comprising a a plurality of box-like holders coupled together for dispensing marking elements wherein each holder comprising a lower part and an upper part, each part having a planar portion with a central hole therein, said lower part and said upper part being connected by means which provides for opening and closing of the two parts, said lower part having a corner provided with an opening protected by a tongue slightly bent outwards, each holder housing a rotatable drum including a core and two circular flanges, a coil of said marking elements wound on said drum, said core extending beyond the flanges and thereby penetrating into the hole in said parts of each holder whereby it can freely rotate, one of said flanges and said core being slotted so that an end of the coil of marking elements is threaded into the slot of the flange and anchored in the slot of the core while the other end protrudes through the opening in the lower part, whereby the user of the dispenser can cut off the required length of marking element, one of said parts having a plurality of bores therethrough about the periphery of said planar portion thereof and the other of said parts having a plurality of matching pins disposed thereon, said pins being operable, when engaged in said bores for locking said parts of a holder together and coupling adjacent holders together.

2. A dispenser according to claim 1 wherein the slot in the drum core is smaller sized than the elements to be wound on the drum so that one end of the elements can be engaged in the slot.

3. A dispenser according to claim 1 wherein the tongue is bent away from the lower part by a distance smaller than the size of the elements to be wound on the drum, so that the elements are stably positioned between the tongue and the lower part with only a small length externally accessible.

4. A dispenser according to claim 1 wherein the means which provides for opening and closing of the two parts are hinges.

5. A dispenser according to claim 1 wherein the means which provides for opening and closing of the two parts are internal hinges having sufficient elasticity to permit opening and closing the two parts.

* * * * *